US011828471B2

(12) United States Patent
Ressler et al.

(10) Patent No.: US 11,828,471 B2
(45) Date of Patent: Nov. 28, 2023

(54) STOWABLE FIRE PIT SCREEN

(71) Applicant: Lamplight Farms Incorporated, Menomonee Falls, WI (US)

(72) Inventors: Kyle Ressler, West Bend, WI (US); Robert Woodruff, Oconomowoc, WI (US); Andrew Alan Harmeling, Milwaukee, WI (US); Daniel J. Knight, Murfreesboro, TN (US)

( * ) Notice: Subject to any disclaimer, the term of this patent is extended or adjusted under 35 U.S.C. 154(b) by 0 days.

(21) Appl. No.: 17/107,248

(22) Filed: Nov. 30, 2020

(65) Prior Publication Data

US 2022/0170637 A1 Jun. 2, 2022

(51) Int. Cl.
*F24B 1/192* (2006.01)
*F24B 3/00* (2006.01)

(52) U.S. Cl.
CPC ..... *F24B 1/192* (2013.01); *F24B 3/00* (2013.01)

(58) Field of Classification Search
CPC .. F24B 3/00; F24B 1/022; F24B 1/192; F24B 1/181; F24B 1/003; F24B 1/198; F24B 1/193; A47J 33/00; A47J 2037/0777; A47J 37/0763; F24C 1/16; F23B 20/00
USPC ..... 126/519, 38, 9 R
See application file for complete search history.

(56) References Cited

U.S. PATENT DOCUMENTS

| | | | | |
|---|---|---|---|---|
| 4,590,919 | A * | 5/1986 | Spani | A47J 37/101 220/370 |
| 5,094,223 | A | 3/1992 | Gonzalez | |
| 5,809,989 | A * | 9/1998 | Nelson | A62C 3/00 126/25 R |
| 5,960,788 | A * | 10/1999 | Bach | A47J 37/0763 126/276 |
| 6,050,256 | A | 4/2000 | French | |
| 8,443,792 | B2 * | 5/2013 | Litzenberger | F24B 1/181 126/29 |
| D820,021 | S | 6/2018 | Henderson | |
| 2003/0015186 | A1 * | 1/2003 | McDonald | F24C 1/16 126/30 |
| 2003/0029443 | A1 | 2/2003 | Davis et al. | |
| 2012/0196232 | A1 * | 8/2012 | Miller | F24B 3/00 431/2 |
| 2019/0162411 | A1 | 5/2019 | Choi et al. | |
| 2019/0313851 | A1 | 10/2019 | Shemp | |
| 2020/0096199 | A1 | 3/2020 | Harrington | |
| 2020/0208842 | A1 | 7/2020 | Jan et al. | |
| 2021/0018180 | A1 * | 1/2021 | Jan | F24C 15/36 |
| 2021/0282592 | A1 * | 9/2021 | Jan | A47J 37/0704 |

FOREIGN PATENT DOCUMENTS

| | | | |
|---|---|---|---|
| CN | 112524644 | A | 3/2021 |
| WO | 2018160767 | A1 | 9/2018 |

* cited by examiner

*Primary Examiner* — Ko-Wei Lin
(74) *Attorney, Agent, or Firm* — GableGotwals; David G. Woodral

(57) ABSTRACT

A fire pit screen has a fire pit screen lower portion including an upright screen wall defining a top opening and a bottom opening, and a fire pit screen upper portion comprising a screen top panel sized to fit on top of the screen wall covering the top opening thereof.

12 Claims, 8 Drawing Sheets

STOWABLE FIRE PIT SCREEN

FIELD OF THE INVENTION

This disclosure related to outdoor fire pits in general and, more specifically, to outdoor fire pits having a top opening for viewing and servicing a fire.

BACKGROUND OF THE INVENTION

Fire pits for burning solid fuels have become a desirable item. These can contain a fire within a specified location and retain ash and other by products for disposal. Fire pits may also have design features that promote rapid combustion of fuel material and brighter flames, while reducing smoke. Such fire pits may burn traditional wood or logs, or utilize engineered wood logs or wood pellets.

Many fire pits are of an open top design and have walls and floors that carefully control air flow to the burning fuel to achieve their desired performance goals. In such cases, the walls may eventually warm up and provide radiant heat but light and flame are primarily or exclusively viewable via the open top. In some cases, air flow in and to the fire, as well as rising combustion gases, can result in ash or solid particles becoming airborne and lofted out of the fire pit. Fire pits can be constructed with higher walls, but this can reduce the visibility of light and flame which is considered desirable by user of fire pits. Certain fire screens or covers are known as well, but these alter the outline, appearance, and/or function of the fire pit in ways that are cumbersome, unattractive, and/or prevent the use of certain accessories such as protective covers and the like.

What is needed is a system and device for addressing the above and other concerns.

SUMMARY OF THE INVENTION

The invention of the present disclosure, in one aspect thereof, comprises a fire pit screen having a fire pit screen lower portion comprising an upright screen wall defining a top opening and a bottom opening, and a fire pit screen upper portion comprising a screen top panel sized to fit on top of the screen wall covering the top opening thereof.

In some cases, the fire pit screen further comprising a base extending from and bounding the lower portion proximate the bottom opening, the base having a lower support surface and a lip. It may comprise an upper ring on the upright screen wall, the upper ring providing a support surface and an inner lip for retaining the fire pit upper portion. There may be a bottom ring on the screen top panel sized to encompass the inner lip and rest on the support surface of the upper ring.

Some embodiments include a hook extending inwardly from the bottom ring and oriented to hang the upper portion on the lower portion when the upper portion is removed from the lower portion.

The upright screen wall may have a frustoconical shape such that the upper portion fits inside the lower portion when the lower portion is inverted. The screen top panel may be a peaked structure extending upward from the lower portion. The screen top panel could be a domed structure. It may have a handle affixed thereto.

The invention of the present disclosure, in another aspect thereof, comprises a fire pit screen having a lower portion with a base configured to fit over a fire pit opening and having a lip preventing lateral movement of the lower portion with respect to the fire pit opening. The fire pit screen includes a wall affixed to the base and extending upwardly therefrom to define a top opening. It has an upper ring on top of the wall, and an upper portion having a top panel secured at a perimeter thereof by a bottom ring thereof. The bottom ring of the upper portion rests on the upper ring of the bottom portion to cover the top opening. Gases and light pass through the wall and the top panel.

In some cases, the fire pit screen upper ring comprises a support ledge with an inner lip sized to fit into the top ring and limit lateral movement of the top portion relative to the lower portion. The wall may define a bottom opening and have a frustoconical shape such that the upper portion fits inside the lower portion when inserted into the bottom opening. The base of the lower portion may extend laterally from the wall with the wall sized and tapered such that the lower portion fits at least partially into the fire pit opening when inverted.

The top panel may have a domed shape. A hook extending inwardly from the bottom ring thereof. A handle may be affixed to the top panel. The wall and top panel may comprise a screen material.

The invention of the present disclosure, in another aspect thereof, comprises a fire pit screen with a lower portion having a first upright configuration in which a frustoconical wall defining an upper opening and a lower openings tapers inward toward the top opening which is smaller than the bottom opening, an upper portion having a top panel sized to cover the top opening but pass through the bottom opening, and a base extending laterally from the frustoconical wall to allow the lower portion to be placed over an opening of a fire pit with the lower portion supported above the opening of the firepit. The lower portion has a second inverted configuration in which the base suspends the lower portion with the wall substantially inside the fire pit opening.

In some embodiments, the base has a base lip limiting lateral movement of the lower portion with respect to the fire pit opening when in the first upright configuration. In some embodiments, the wall has a support ring circumscribing the upper opening, the support ring having a support ring lip limiting lateral movement of the upper portion when the lower portion is in the first upright configuration.

DETAILED DESCRIPTION OF THE PREFERRED EMBODIMENTS

Figure 1:
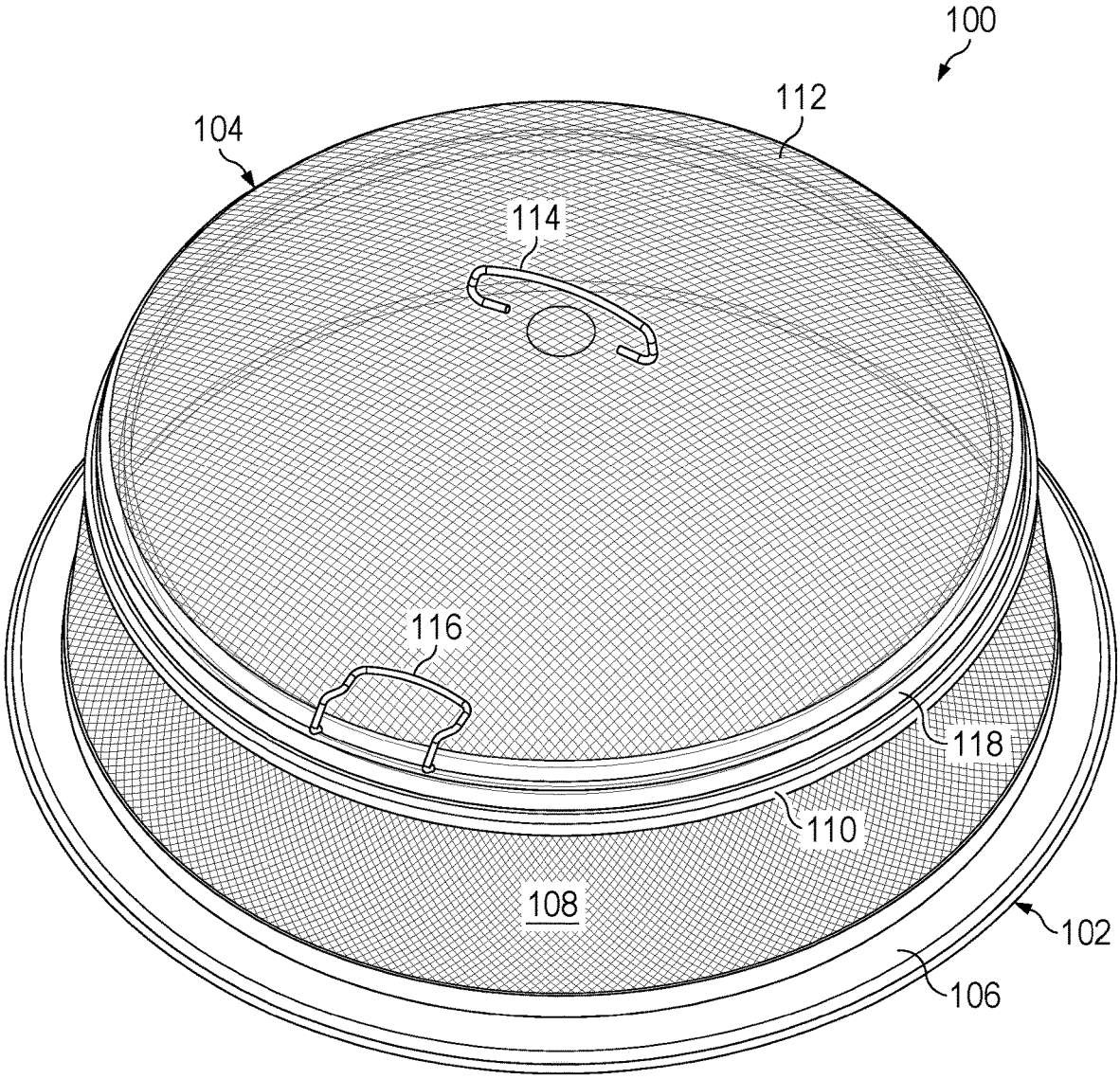
FIG. 1 is a perspective view of a stowable fire screen according to aspects of the present disclosure.

Referring now to FIG. 1, a perspective view of a stowable fire screen 100 according to aspects of the present disclosure is shown. The fire screen 100 is shown inside view in FIG. 2 and in top down view in FIG. 3. The fire screen 100 comprises a lower fire screen portion 102 supporting an upper fire screen portion 104, which may also be thought of as a removeable lid to the lower portion 102.

The lower portion 102 may comprise a wall 108 with a base 106 on a lower edge thereof. The base 106 may extend laterally away from the wall 108. The wall 108 may be at least partially upright and have an upper ring 110 on an upper edge thereof. In some embodiments, the wall 108 is a screen wall. In other embodiments, it may comprise a mesh material or some other configuration that would allow combustion gases to escape and allow for viewing of a fire or flame through the wall 108.

Figure 2:
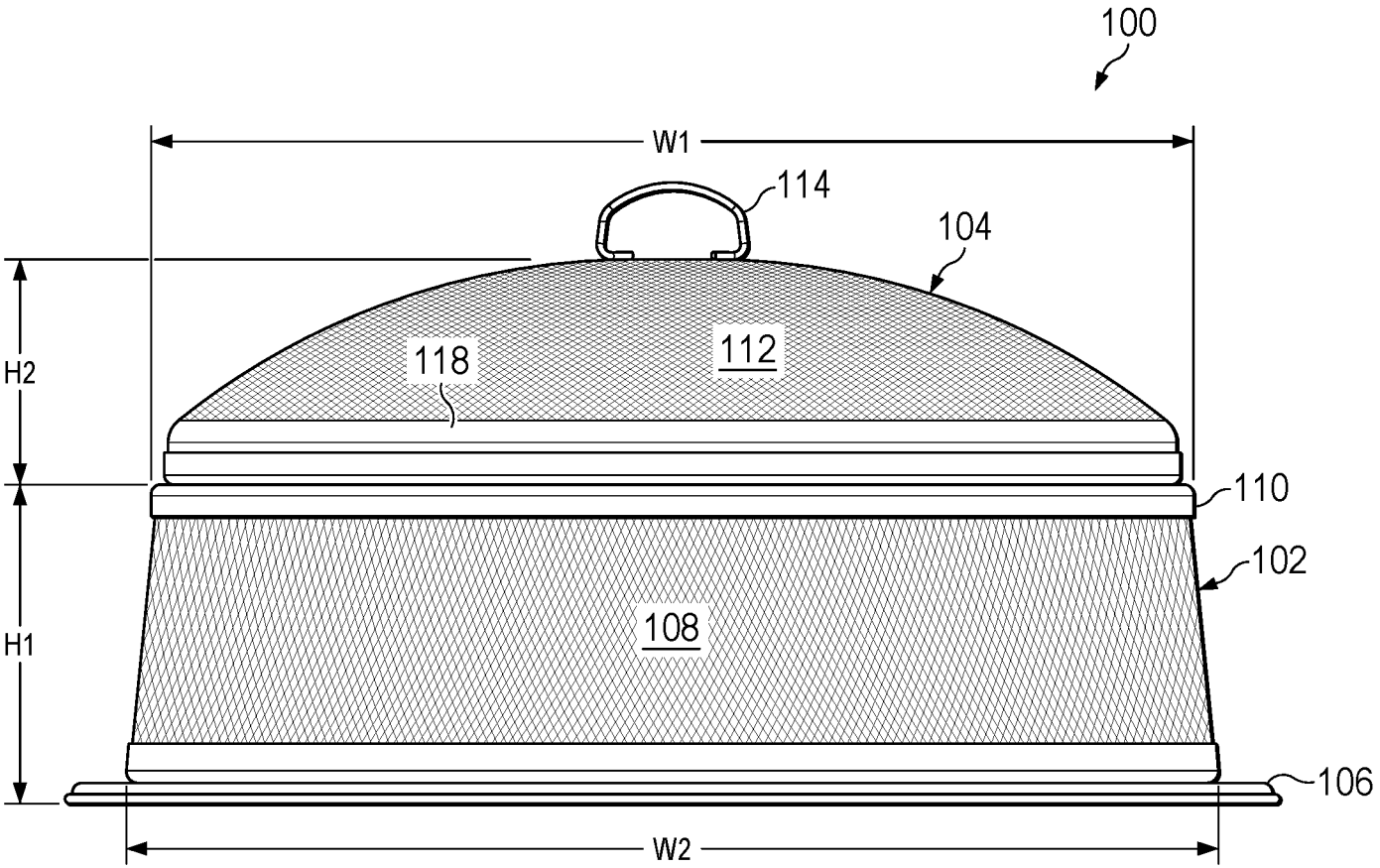
FIG. 2 is a side view of the stowable fire screen of FIG. 1.
Figure 3:
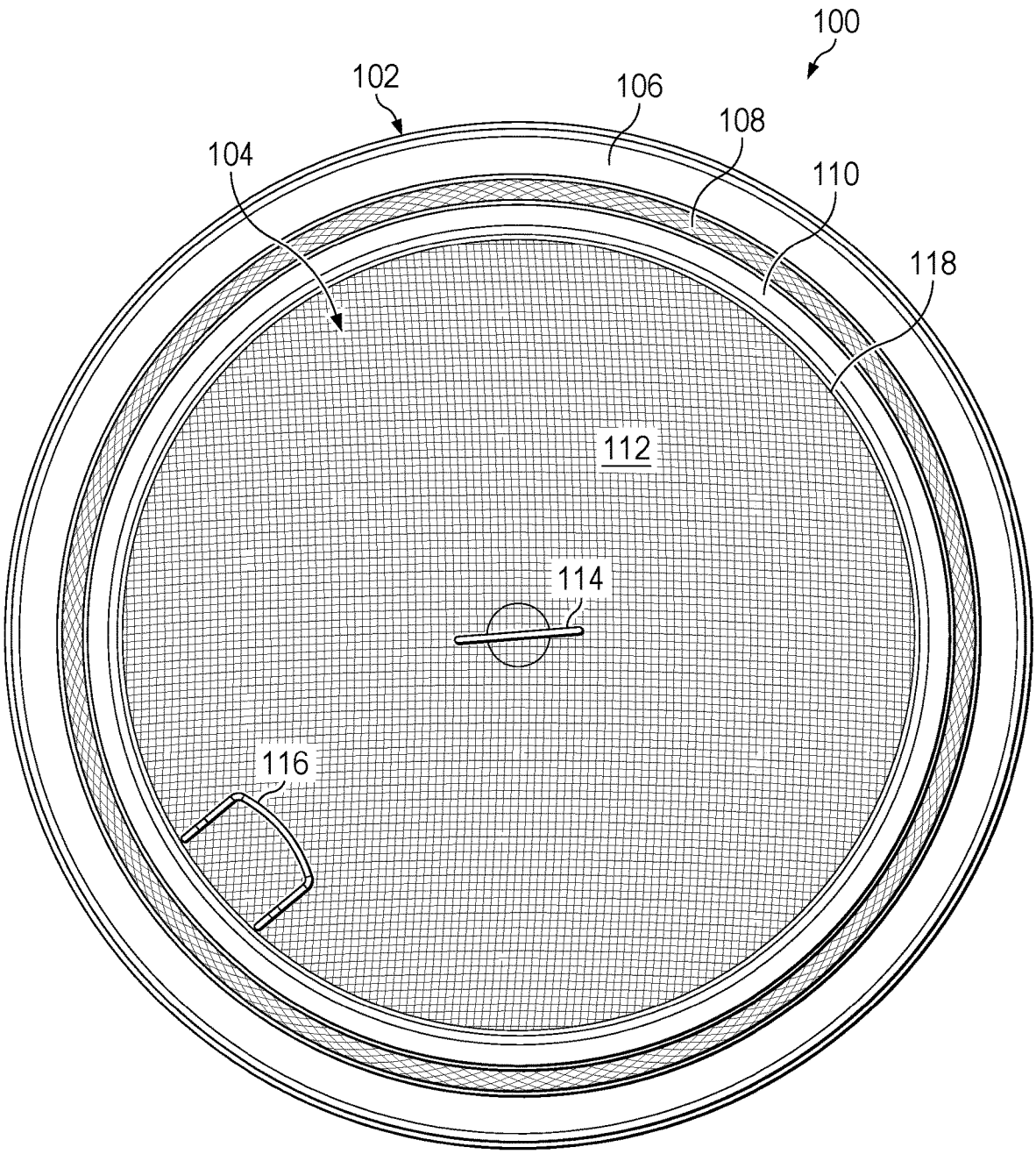
FIG. 3 is a top down view of the stowable fire screen of FIG. 2.
Figure 4:
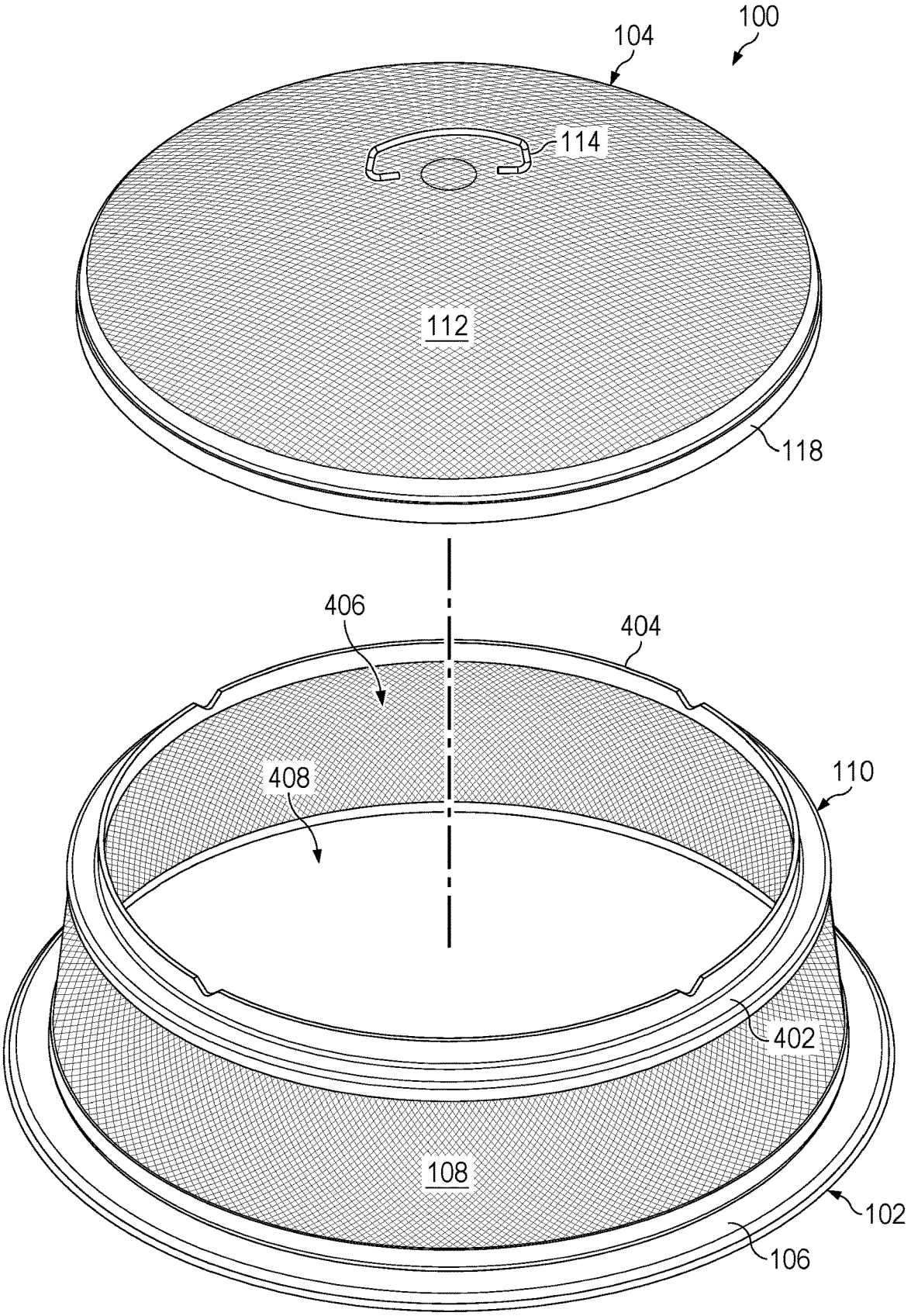
FIG. 4 is a perspective view of the stowable fire screen of FIG. 1 with the top removed.

As seen in FIG. 2, the wall 108 may have an upper width W1 that is less than a lower width W2, resulting in an inward tapering or frustoconical configuration. As seen in FIG. 4, an upper opening 406 of the wall 108 may be smaller than a lower opening 408 of the wall 108. The wall 108 may be cylindrical, or have other geometries as well. In cases where the upper and lower edges of the wall 108 are circular, the upper ring 110 and base 106 may be generally circular, at least where they meet or attach to the wall 108. Thus, the width W1 may correspond to a diameter of an upper circular cross section of the wall 108 (i.e., opening 406) and W2 may correspond to the diameter of a lower circular cross section (i.e., opening 408) of the wall 108.

The wall 108, including the base 106 and top ring 110 may have a height H1 that may vary according to expected flame height inside the fire screen 100. A height 112 of the upper portion 104 added to the height H1 results in a total height of an enclosed volume of the fire screen 100 in which visible flames may be viewed.

It should be understood that the wall 108 may have multiple segments joined together to create the wall 108. Such segments are not necessarily curved but may also comprise flat or planar panel portions according to the overall geometry of the wall 108 and the lower portion 102. Where the geometry of the wall 108 is other than frustoconical, the base 106 may have a general shape other than circular in order to meet and attach to the wall 108.

The upper portion 104 may comprise a top panel 112 bounded by a bottom ring 118. The bottom ring 118 of the upper portion 104 may fit cooperatively with the top ring 110 of the bottom portion 102 such that the upper portion 104 forms a lid for the lower portion 102. In this way, the fire screen 100 may be installed onto a fire pit with the upper portion 104 being selectively removable buy a user from the bottom portion 102 for tasks such as fuel replenishment. To that end a handle 114 may be provided on the upper portion 104. The upper portion 104 may also be provided with a hook 116, possibly affixed to the lower ring 118 below the top panel 112, for hanging the upper portion 104 on the lower portion 102 when the top portion 104 is removed from its operational position as shown.

The top panel 112 may comprise a dome-shaped screen or mesh such that smoke and combustion gases can escape while flames remain visible through the top panel 112. In other embodiments, the top panel 112 may have a conical or frustoconical appearance. The top panel 112 could also provide another peaked or elevated geometry extending upwards from the lower portion 102 In further embodiments, the top panel 112 may be a planar or flat component, but this would reduce the total interior volume of the screen 100 by reducing height 112 to substantially zero. In such cases, the height H1 may be extended to retain similar internal volume.

It should be understood that the bottom ring 118 of the upper portion 104 and the top ring 110 of the lower portion 102 may have complementary or matching shapes regardless of the overall geometries of the upper portion 104 and lower portion 102 such that the upper portion 104 fits as a lid to the lower portion 102. The fit between bottom ring 118 and upper ring 110 may be without visible gaps though it is not necessarily gas or airtight.

All components of the fire screen 100 may comprise flame resistant steels or other materials that can withstand continued exposure to combustion temperatures encountered in outdoor wood fires or fire pits. Individual subcomponents or pieces may be joined together by folds, welds, rivets, or other mechanisms known in the art. All or part of the fire screen 100 may be coated with heat resistant paint or another protective layer or covering.

Referring now to FIG. 4, a perspective view of the stowable fire screen 100 of FIG. 1 with the top (upper portion 104) removed is shown revealing a top opening 406 and a bottom opening 408. It can also be seen the top opening 406 may be sized such that the upper portion 104 fits as a lid thereto, while the bottom opening 408 is larger (wider) than the upper portion such that the upper portion 104 can fit into the lower portion 102.

From the view of FIG. 4 the cooperating, generally circular form of the bottom ring 118 and upper ring 110 may be further appreciated. The upper ring 110 of the lower portion 102 may be further subdivided into a support surface 402 and an inner lip 404 (extending upwardly in this view). The lip 404 may be on the interior of the upper ring 110 and sized to fit into the bottom ring 118 of the upper portion 104 while the bottom ring rests on the support surface 402. In this way the upper portion 104 is retained in the proper position with respect to the lower portion 102 and it less likely to be inadvertently knock off or otherwise disturbed. This configuration may also be reversed with a lip (not shown) on the upper ring 110 that fits into the bottom ring 118.

Figure 5:
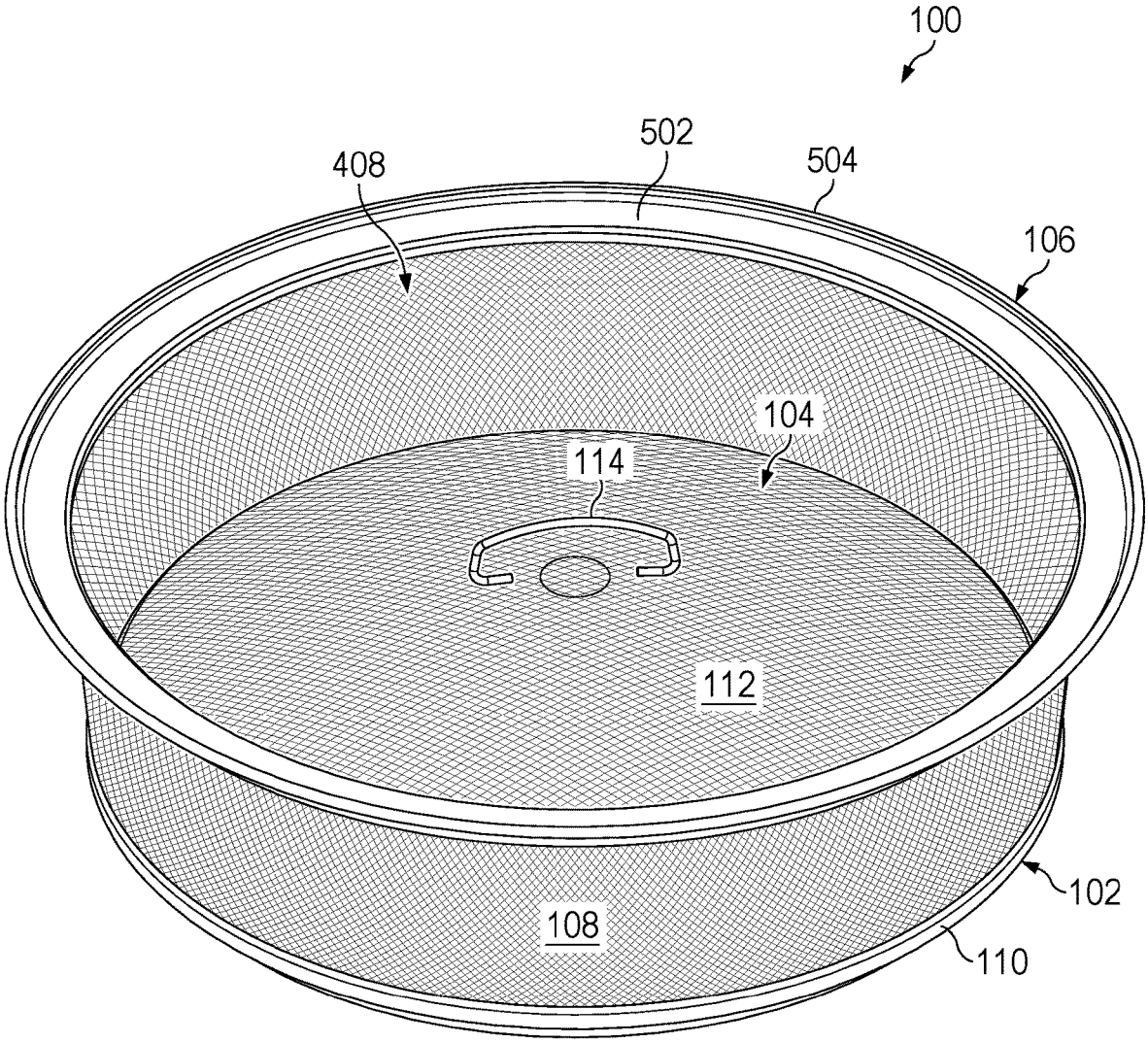
FIG. 5 is a perspective view of the stowable fire screen of FIG. 1 in a stowed configuration.

Referring now to FIG. 5, a perspective view of the stowable fire screen 100 of FIG. 1 in a stowed configuration is shown. Here, the lower portion 102 is inverted and the top portion 104 rests inside the lower portion 102. The sizes and spacing of components may be such that the upper portion 104 rests on an opposite side of the upper ring 110 from when the device 100 is in operational configuration. In some embodiments, the upper portion 104 rests on an opposite side of the support surface 402 from the operational configuration of FIGS. 1-2.

From the inverted perspective viewpoint of the lower portion 102 in FIG. 5, it can be seen that a bottom or lower side of the base 106 may further comprise a support surface 502 surrounded by a lip 504 (extending upwardly in this view). In some embodiments the lip 504 is an outer lip as shown such that the lip 504 circumscribes a top-ring or lip of a fire pit upon which it rests in the operational configuration. However, the lip 504 could be an interior lip to fit into a fire pit top opening. In either case, the base 106 and therefore the fire screen 100 may be retained securely atop of an operational firepit.

Figure 8:
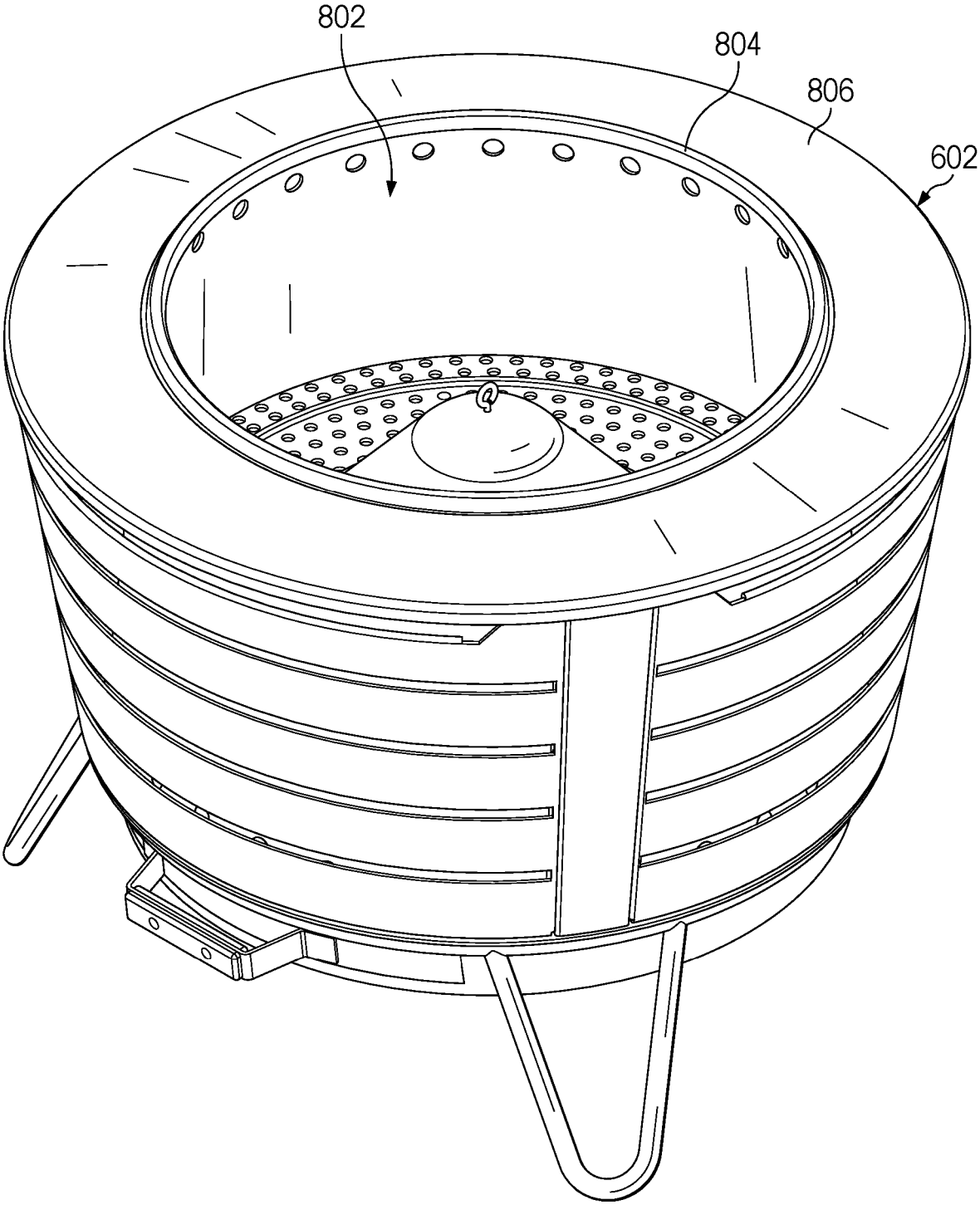
FIG. 8 is a perspective view of a fire pit for use with various embodiments of the stowable fire screen of the present disclosure.

Referring now to FIG. 8, a perspective view of a fire pit 602 for use with various embodiments of the stowable fire screen 100 of the present disclosure is shown. In one specific application, the fire pit 602 is substantially similar to one described in US Patent Application Publication No. 2020/0096199 by Harrington, et al., which is hereby incorporated by reference as if set out herein in its entirety. However, as respecting the instant specification, the fire pit 602 is only exemplary, as the fire screen 100 may find application with other fire pits and devices. The fire pit 602 can be seen to include a central fire opening 802, which may be bounded by a lip 804 and/or a surrounding ledge 806. The fire pit 602 may have features as are known in the art to promote even burning and rapid ignition of solid fuels while reducing smoke.

Figure 6:
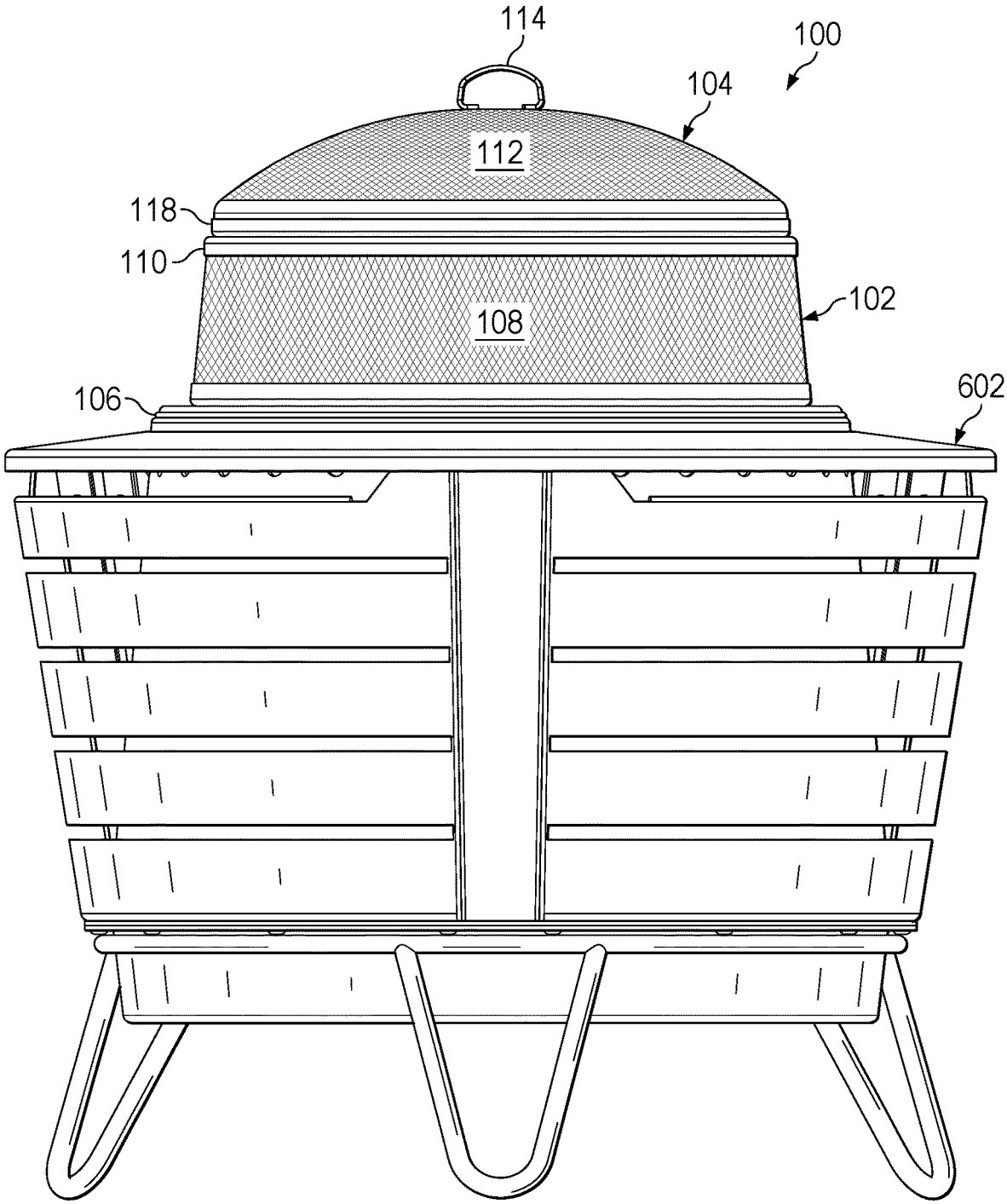
FIG. 6 is a side view of a stowable fire screen according to the present disclosure placed in an operational configuration on a fire pit.

Referring now to FIG. 6, a side view of a stowable fire screen 100 according to the present disclosure placed in an operational configuration on the fire pit 602. The fire screen 100 sits atop an upper opening of the fire pit 602 and is sized and configured such that the base 602 sits over the opening (802, FIG. 8) and is secured against lateral movement by the lip 504 in cooperation with a top ring or lip (804, FIG. 8) of the fire pit 602 surrounding the opening. Where no lip 804 is provided, the fire screen 100 may sit over the opening 802 with base 602 resting on the ledge 806, for example. In such cases, the lip 504 may be an interior lip (e.g., interior to support surface 502; see FIG. 5) and insert some distance into the opening 802 to secure the fire screen 100 against lateral movement relative to the fire pit 602.

The fire screen 100 may be placed as described and the top portion 104 selectively removed from the bottom portion 102 for tending the fire in the fire pit 602 as needed. As described, the hook 116 (FIG. 1) may be used to hang the upper portion 104 on the lower portion 102 when the screen 100 is opened. The height of the fire screen 100 allows flames to escape the fire pit 602 and be observed, and to provide warmth and light. The fire screen 100 may reduce the chance of ash, cinders, or sparks cinders escaping while combustion gases can flow through freely.

Figure 7:
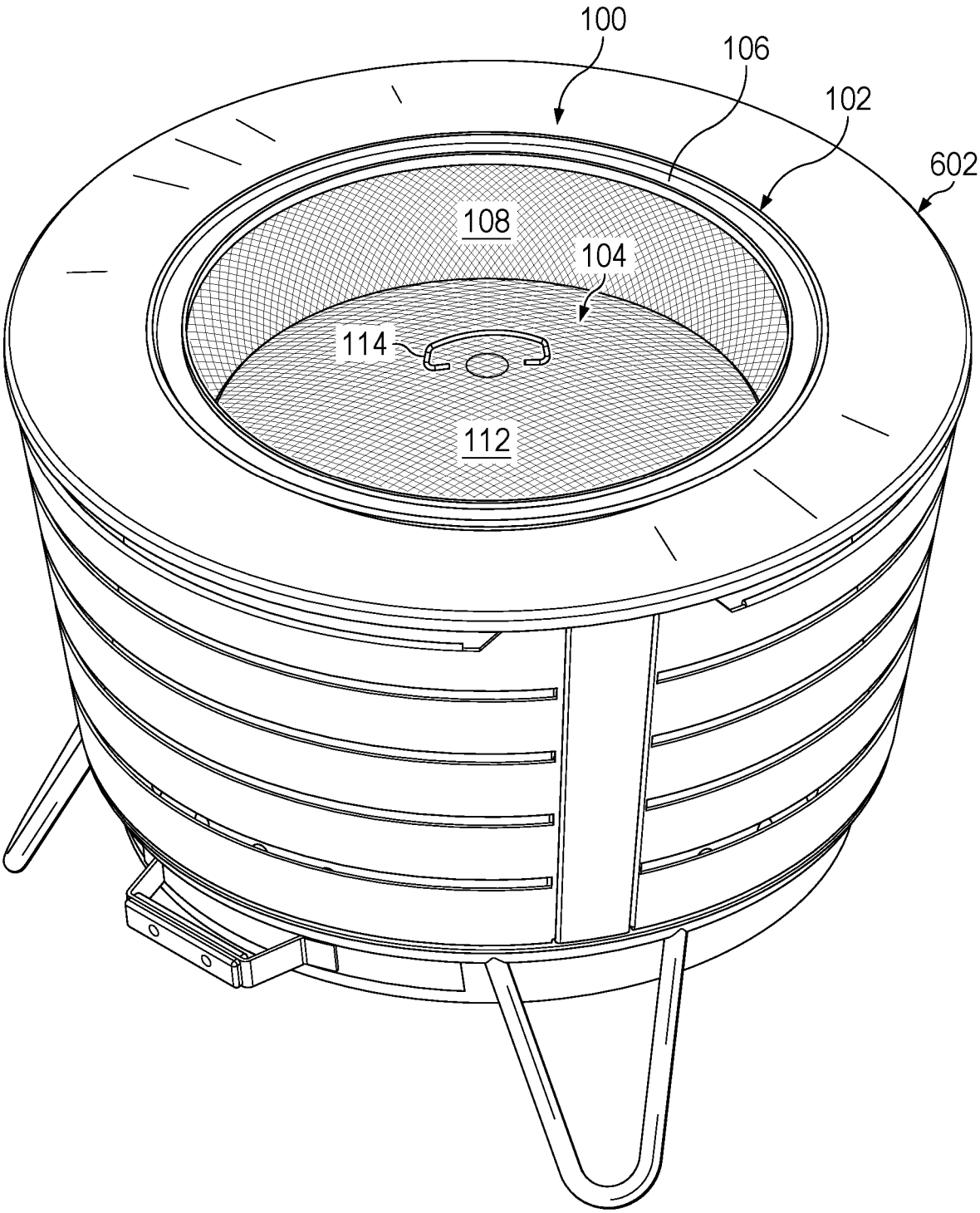
FIG. 7 is a perspective view of a stowable fire screen according to the present disclosure stowed in a fire pit.

Referring now to FIG. 7, a perspective view of the stowable fire screen 100 according to the present disclosure is illustrated stowed in the fire pit 602. Here the screen 100 has been removed from the fire pit 602 and placed into the stowed configuration as illustrated in FIG. 5. The fire screen 100 may also be placed into the top opening 802 of the fire pit 602. In this way the fire screen 100 does not appreciable increase the size of any storage or shipping container of the fire pit 602, nor does it cause any covers or accessories sized for the fire pit 602 to become unfit for use. For example, a cover sized to fit the fire pit 602 would fit the fire pit 602 even with the fire screen 100 included (at least in a stowed configuration). Additionally, in the stowed configuration, any other accessories that might sit on top or over the fire pit 602 (such as a table top or other surface) would still function properly.

From FIGS. 6-7 it may also be appreciated that an operational configuration of the fire pit screen 100 is considered to be one where the lower portion 102 is in an upright position and rests on the fire pit 602 to cover the opening 802 thereof while supporting the top portion 104 atop the wall 108. Note that an operational configuration would include a situation where the upper portion 104 is attached to the lower portion 102 via hanger 116 or has been removed completely from the upright lower portion 102. A stowed configuration would be one where the lower portion 102 has been placed in an inverted position such that the wall 108 can be placed substantially inside the opening 802 of the firepit with the fire pit screen suspended in the opening 802 via the base 106. The upper portion 104 then fits partially or completely inside the upper portion 102.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fire pit screen comprising:

a fire pit screen lower portion comprising a screen wall defining a relatively smaller top opening and a relatively larger bottom opening, the screen wall tapering from the bottom opening to the top opening, and the top opening being circumscribed by a lower portion top ring providing an upper support surface having first and second sides; and a fire pit screen upper portion comprising a screen dome extending away from an upper portion bottom ring;

wherein the fire pit screen upper portion bottom ring is supported by the lower portion top ring when the fire pit screen upper portion is in an upright position and the fire pit screen lower portion is in an upright position or in an inverted position; and wherein a fit between the upper portion bottom ring and the lower portion top ring is without visible gaps when the lower portion is in the upright position or in the inverted position.

2. The fire pit screen of claim 1, further comprising a base extending from and bounding the screen wall proximate the bottom opening, the base having a lower support surface and a lip.

3. The fire pit screen of claim 1, further comprising an inner lip on the upper support surface.

4. The fire pit screen of claim 1, further comprising a hook extending inwardly from the bottom ring and oriented to hang the upper portion on the lower portion when the upper portion is removed from the lower portion.

5. The fire pit screen of claim 1, wherein the screen dome has a handle affixed thereto.

6. A fire pit screen comprising:

a lower portion having a base configured to fit over a fire pit opening, the base having a lip preventing lateral movement of the lower portion with respect to the fire pit opening;

a wall affixed to the base and tapering upwardly therefrom to define a top opening;

an upper ring on top of the wall; and an upper portion having a top panel secured at a perimeter thereof by a bottom ring thereof;

wherein the top panel is domed and extends upwardly above the bottom ring;

wherein the bottom ring of the upper portion rests on the upper ring of the bottom portion to cover the top opening;

wherein the bottom ring of the upper portion rests on the upper ring of the lower portion when the lower portion is inverted and the upper portion is placed upright into the lower portion;

wherein the base of the lower portion is wider than a width of the firepit opening allowing the lower portion to be suspended by the base into the firepit opening when the lower portion is inverted;

wherein gases and light pass through the wall and the top panel; and wherein when the bottom ring of the upper portion rests on the upper ring of the lower portion when the lower portion is inverted and the upper portion is placed upright into the lower portion, a handle of the upper portion is not in contact with the wall of the lower portion.

7. The fire pit screen of claim 6, wherein the upper ring comprises a support ledge with an inner lip sized to fit into the upper ring and limit lateral movement of the top portion relative to the lower portion.

8. The fire pit screen of claim 6, further comprising a hook extending inwardly from the bottom ring.

9. The fire pit screen of claim 8, wherein the wall and top panel comprise a screen material.

10. A fire pit screen comprising:

a lower portion having a first upright configuration in which a frustoconical wall defining a top opening and a bottom opening tapers inward toward the top opening which is smaller than the bottom opening;

an upper portion having a bottom ring attached to a domed screen top panel extending upwardly and above the bottom ring, the top panel sized to cover the top opening but pass through the bottom opening; and a base extending laterally from the frustoconical wall to allow the lower portion to be placed over an opening of a fire pit with the lower portion supported above the opening of the firepit;

wherein the lower portion has a second inverted configuration in which the base suspends the lower portion with the wall substantially inside the fire pit opening;

wherein in the base has a support surface with a first side that supports the upper portion in the first upright configuration and a second side that supports the upper portion in the second inverted configuration;

wherein the support surface of the base is the entire support for the upper portion when in the first upright configuration and in the second inverted configuration.

11. The fire pit screen of claim 10, wherein the base has a base lip limiting lateral movement of the lower portion with respect to the fire pit opening when in the first upright configuration.

12. The fire pit screen of claim 10, wherein the wall has a support ring circumscribing the upper opening, the support ring having a support ring lip limiting lateral movement of the upper portion when the lower portion is in the first upright configuration.

* * * * *